United States Patent [19]

Bilek et al.

[11] Patent Number: 4,482,900

[45] Date of Patent: Nov. 13, 1984

[54] DEPLOYABLE FOLDED ANTENNA APPARATUS

[75] Inventors: Frank V. Bilek, Littleton, Colo.; David N. Buell, Mandeville, La.

[73] Assignee: The United States of America as represented by the Secretary of the Air Force, Washington, D.C.

[21] Appl. No.: 417,726

[22] Filed: Sep. 13, 1982

[51] Int. Cl.[3] ..... H01Q 15/20

[52] U.S. Cl. ..... 343/915; 343/DIG. 2

[58] Field of Search ..... 343/DIG. 2, 915, 880, 343/881; 244/173

[56] References Cited

U.S. PATENT DOCUMENTS 4,030,102 1/1977 Kaplan et al. ..... 343/DIG. 2

*Primary Examiner*—Eli Lieberman

*Assistant Examiner*—K. Ohralik

*Attorney, Agent, or Firm*—Donald J. Singer; William Stepanishen

[57] ABSTRACT

An antenna apparatus for use in space which is foldable into a small package for storage in a space vehicle. The antenna apparatus utilizes a plurality of hinged members and diagonal tapes forming parallelogram frames, two opposite sides of which are hinged at the center to fold the frames in a given plane. Similar frames are hinged on the first frames in a second plane whereby a plurality of cubes are formed when all are unfolded.

10 Claims, 19 Drawing Figures

FIG.1
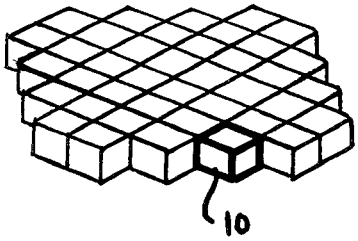
FIG.2a
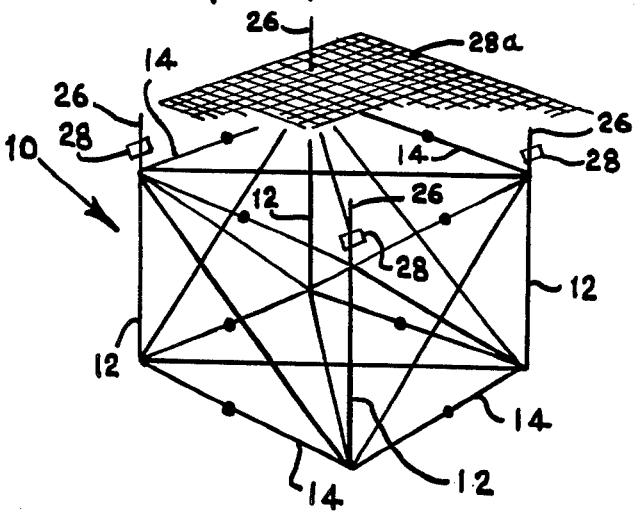
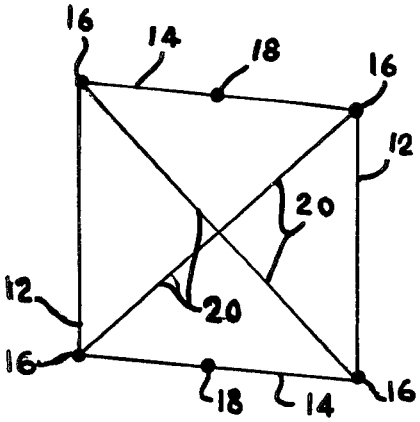
FIG.2b
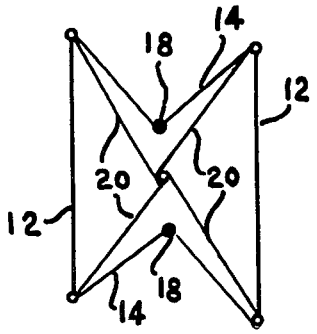
FIG.2c
FIG.2d
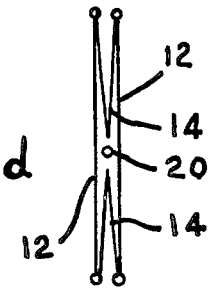

DEPLOYABLE FOLDED ANTENNA APPARATUS

STATEMENT OF GOVERNMENT INTEREST

The invention described herein may be manufactured and used by or for the Government for governmental purposes without the payment of any royalty thereon.

BACKGROUND OF THE INVENTION

The present invention relates broadly to antenna structures, and in particular to a deployable folded antenna apparatus.

There are several different types of antenna structures that are used in communication and navigation systems. While each type is unique in its application, paraboloidal-type antennas have been found to be particularly useful in many of such systems. However, the use of paraboloidal antennas is normally limited because of the reflector size, the surface and contour tolerance that can be maintained when using higher frequencies and their weight. Thus while in many applications it is particularly advantageous to use large paraboloidal reflectors, it is often necessary to build up the structure in rather inaccessible or inconvenient places which makes their use impractical in these inaccessible places. As for example, it is difficult to use a parabolic reflector antenna of large size in space, because of the difficulty of lifting such a large structure into space and assembling it there. Further, it is usually impractical to use large paraboloidal antennas on, for example, small ships or the like where space is limited. Thus, in many such applications smaller paraboloidal antennas are used when larger ones are desired.

There are several expandable antenna structures that have been used in attempts to solve the foregoing problems. Examples of these antenna structures are assembled rigid panelled modules, hinged rigid panels, and inflatable structures. Such structures are either constructed or expanded at point of use into the large paraboloidal reflector. In using such structures, it is necessary that the imperfections in the structure be held at a minimum since as the wavelength becomes shorter, the imperfections in the structure become an appreciable fraction of the wavelength. In this regard, the rigidity of inflatable-type structures is difficult to maintain. Modular-type construction and hinged rigid panels are limited in use by their heavy weight and because they are difficult to assemble at point of use, and because it is difficult to package them compactly. It would therefore be advantageous to have a relatively lightweight, expandable paraboloidal antenna that is easily and automatically expanded into a paraboloidal reflector at point of use and which paraboloidal antenna, when expanded, has a rigid truss-type structure that assures a contour tolerance that will permit the transmitting or receiving of higher frequency signals.

SUMMARY OF THE INVENTION

The present invention utilizes a basic box truss structure to construct a plurality of cubic truss elements. The cubic truss elements are arranged to form truss squares for each side of a cube. A plurality of cubes comprising box truss elements are combined to form a collapsible structure such as a space antenna. The cubes have foldable horizontal elements with diagonal tapes in each cube plane surface to provide rigidity when the cube is deployed.

It is one object of the present invention, therefore, to provide an improved deployable folded antenna apparatus.

It is another object of the invention to provide an improved deployable folded antenna apparatus which is foldable into a small package for storage in a space vehicle.

It is another object of the invention to provide an improved deployable folded antenna apparatus which comprises a plurality of cubic truss elements.

It is another object of the invention to provide an improved deployable folded antenna apparatus wherein diagonal tapes are utilized in each cube plane surface to provide structural rigidity when deployed.

These and other advantages, objects and features of the invention will become more apparent after considering the following description taken in conjunction with the illustrative embodiment in the accompanying drawings.

BRIEF DESCRIPTION OF THE DRAWINGS

FIG. 1 is an isometric view of the deployable box truss antenna apparatus;

FIG. 2*a* is an isometric view of a single cube element from the structure shown in FIG. 1;

FIG. 2*b* is a front view of a side of the cube element of FIG. 2*a;*

FIG. 2*c* is a front view of a partially folded truss element;

FIG. 2*d* is a front view of a completely stowed truss element;

DESCRIPTION OF THE PREFERRED EMBODIMENT

Figure 3:
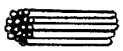
FIG. 3 is an isometric view of a stowed six cube by six cube truss structure.

Referring now to FIG. 1, there is shown a fully deployed box truss structure which is comprised of a plurality of cubic truss elements of which one cube 10 has been highlighted. There is shown in FIG. 2*a* the single cube 10 of FIG. 1 in greater detail. The cubic truss element 10 is comprised of a plurality of vertical members 12 which are positioned at the four corners of the cube. The vertical members 12 are connected together by top and bottom surface members 14. Support posts 26 are connected to the vertical members 12. The support posts 26 have a mesh support means 28 mounted thereon to support the antenna surface 28*a*. Surface members, hinged in the middle, connect each vertical member to each of its neighbors. Each truss square, composed of surface members and vertical members, is stabilized by diagonal tension tapes. For stowage, each surface member folds about its midlink hinge and the diagonal tapes form a coil between the stowed mid-link hinges.

In FIG. 2*b*, there is shown in still greater detail the structural elements which comprise one face or plane surface of the cube 10 of FIG. 2*a*. The vertical members 12 are connected to the surface member 14 by any suitable or conventional end fitting means 16. Each surface member 14 contains a midlink hinge 18 which enables the member to be folded. The midlink hinge 18 may be any conventional or other suitable hinge that is foldable and is structurally rigid when fully extended. The diagonal tapes 20 are shown connecting the corners of the square and are utilized to provide structural rigidity and strength when the frame is fully extended.

There is shown in FIG. 2*c* the partially stowed square frame of FIG. 2*b*. The surface members 14 are folded about their midlink hinges 18 both of which move inwardly in the stowing operation. The vertical members 12 move towards each other while the diagonal tapes 20 form a coil between the element. In FIG. 2*d*, there is shown the frame square of FIG. 2*c* in the completely stowed configuration.

Figure 4:
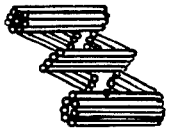
FIG. 4 is an isometric view of the truss structure of FIG. 3 in the first stage of row deployment.
Figure 5:
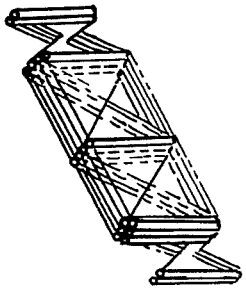
FIGS. 5 through 7 are isometric views respectively of the row deployment for the truss structure from partial to full row deployment.
Figure 6:
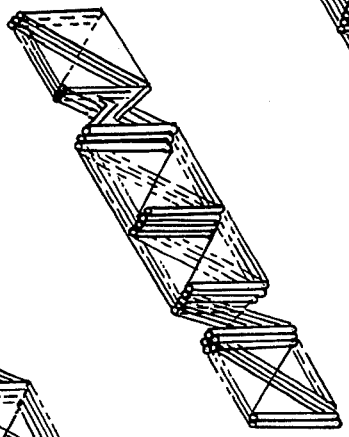
Figure 7:
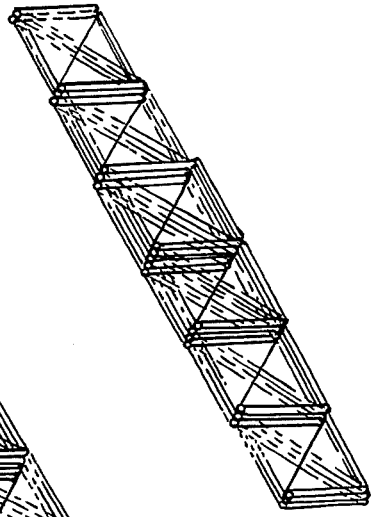

Turning now to FIGS. 3 through 11, there is shown in a sequence of steps the deployment of a six cube by six cube truss from the completely stowed stage to the fully deployed truss stage. In FIG. 3, the six by six cube is shown in the fully stowed state. In FIG. 4, the deployment of the rows is shown with the partial expansion of two cube rows. In FIG. 5, the first two cube rows are fully extended and the two more cube rows are partially extended. The row expansion process continues as shown in FIG. 6 until there is accomplished the complete row deployment as shown in FIG. 7. The truss structure in this expansion sequence is comprised of twenty four cubes which form six rows and six columns. In this example, the cube faces forming the innermost row on each side of the centerline are deployed first. Following verification that this step has been completed successfully (a procedure followed between all steps), the outermost rows are deployed. Symmetrical pairs may be deployed simultaneously to balance reaction forces. This preserves the deploying structure's attitude and center of gravity position. The row deployment step involving the middle rows on each side results in full deployment steps, in this case working from the outside to the center, in a sequence that completes the truss deployment.

Figure 9:
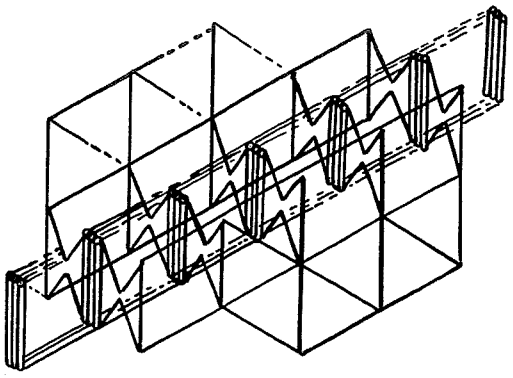
FIGS. 8 through 10 are isometric views respectively of the column deployment for columns 1–3 of the truss structure of FIG. 3.
Figure 10:
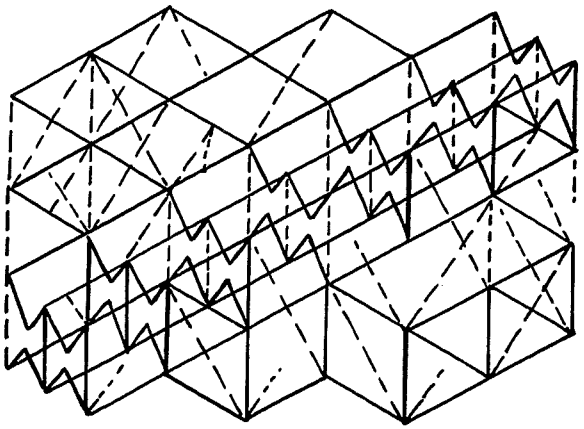
Figure 8:
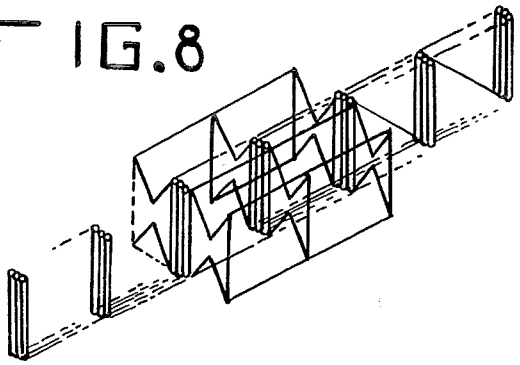
Figure 11:
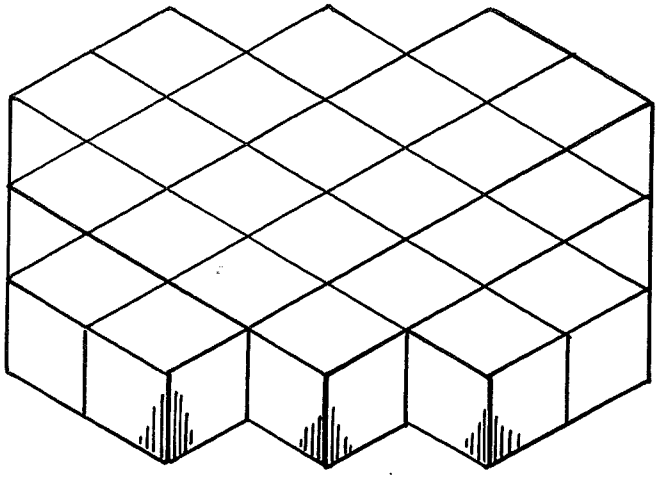
FIG. 11 is a isometric view of the truss structure of FIG. 3 in full deployment.

Once the row deployment process has been completed, the process of column deployment begins as shown in FIG. 8. There is shown in FIG. 8, the partial expansion of two columns. In FIG. 9, there is shown the complete expansion of the first two cubes and the first two columns with the partial expansion of second two columns and other cubes in the first two columns. The column expansion process continues as shown in FIG. 10, until the fully deployed truss state, as shown in FIG. 11, is reached. In FIG. 11, all the cubes of all the rows are fully extended to provide a completely deployed six cube by six cube truss structure. The truss structure which is described above may employ any suitable or conventional means for methods to effect the expansion and extension of the cube truss elements.

Figure 13A:
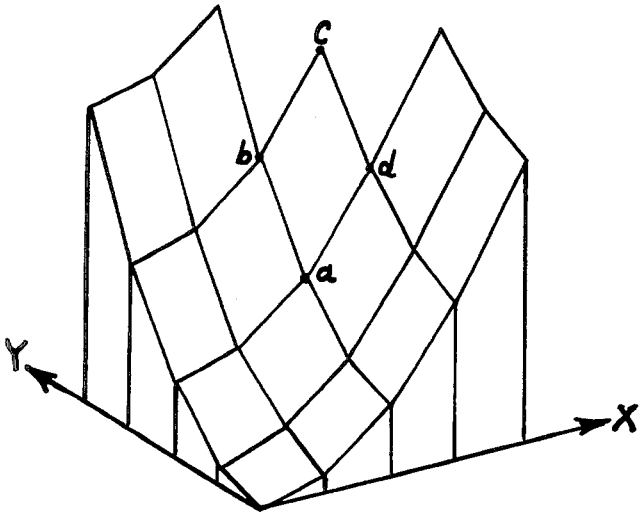
FIGS. 13*a, b* and *c* are graphic representations respectively of a parabolic surface showing a given parallelogram in the designated directions.

The necessary dimensions of truss elements which are derived in the analysis, are as follows. The analysis provides that:

(1) Each surface unit shown typically as abcd in FIG. 13*a* is a parallelogram (instead of a square as in the planar version).

(2) All of the surface tubes in any row (i.e., between $x=x_1$ and $x=x_1+1$) or column (between $y=y_1$ and $y=y_1+1$) are equal.

(3) The corresponding diagonals between upper and lower surfaces in any row or in any column are all equal.

In the present sense, the statement that the corresponding diagonals are equal refers to the fact that all top-right to bottom-left diagonals form one group of corresponding diagonals and the top-left to bottom-right diagonals form another group.

A parabolic surface or any other surface may be made of box truss elements, however, it is not so obvious that such a configuration will fold. The three conditions above are sufficient to demonstrate that the parabolic surface is foldable. They determine that when a row or column is in the stowed configuration, the hinge pins of that row or column will be in line, and hence represent a feasible configuration for packaging in the orbiter or another vehicle. The following analysis develops the equations which illustrate that a folded box truss parabolic surface structure is deployable.

Figures 12A, 12B:
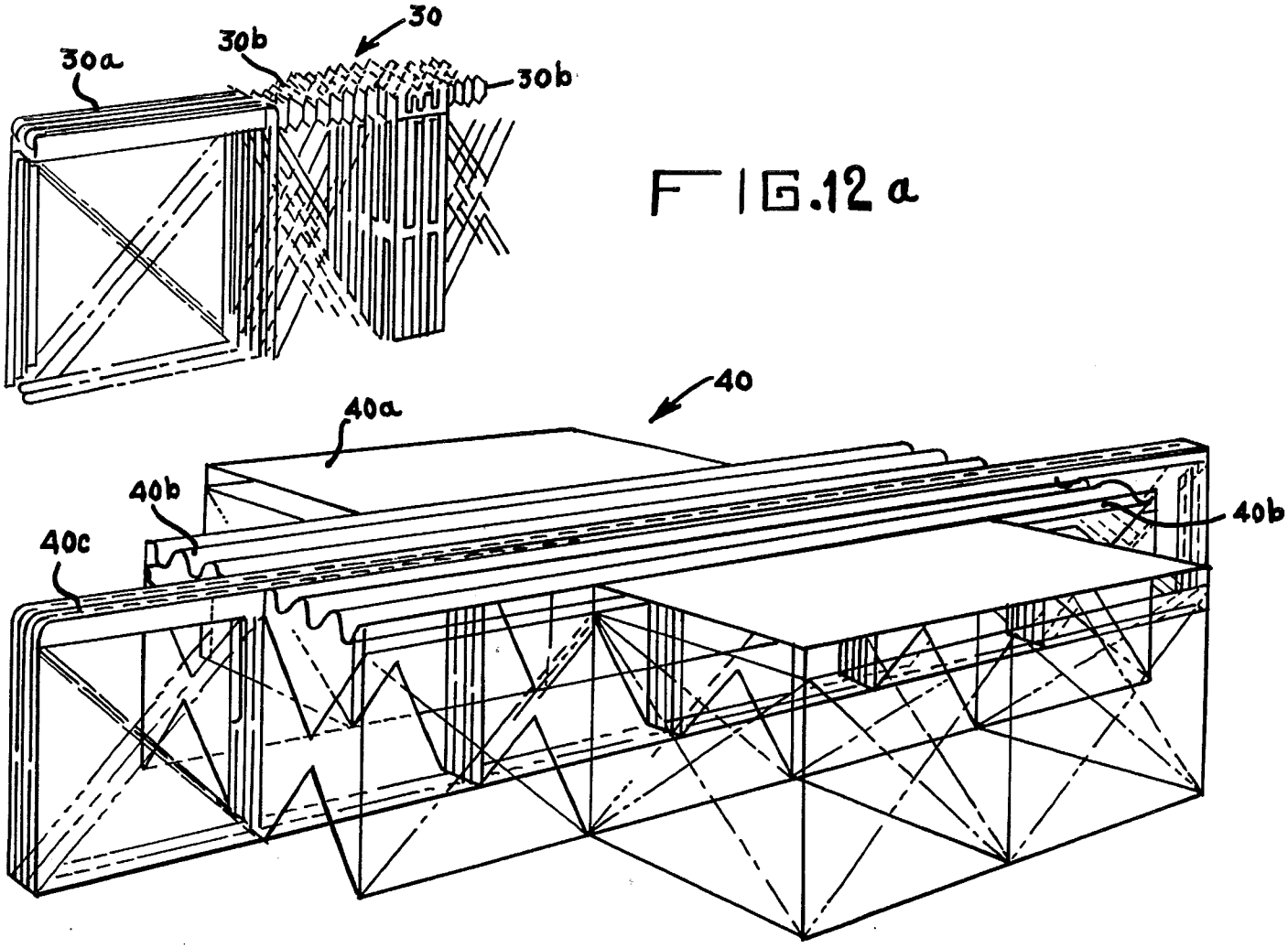
FIGS. 12*a, b* are isometric views respectively of an array surface illustrating row and column deployment.

There is shown in FIGS. 12*a* and 12*b*, an example of a box truss structure which is supporting a surface array. The surface array may comprise any type element as a given application may require, such as the elements of an antenna or reflector. In FIG. 12*a*, there is shown the row deployment in which the surface element 30 is double accordian-pleated, fully deployed 30*a* and partially deployed 30*b*. In FIG. 12*b*, there is shown the various stages of column deployment in which the surface element 40 is shown fully deployed 40*a*, partially deployed 40*b*, and fully stowed 40*c*. Thus, there is illustrated in FIGS. 12*a* and 12*b* the manner in which a box truss structure can support and deploy a surface which is stowed in a double accordian configuration.

The present invention as herein described has been directed to a box truss structure which, when unfolded would provide a flat surface that is planar. However, there is also provided an analysis of the development of equations illustrating that a parabolic surface may also be deployed by using a box truss structure. There will be shown in FIGS. 13*a*, 13*b* and 13*c* that a planar truss will result when the verticals are all of equal length, the surface members are all of the equal length, and the diagonal tension tapes are all equal.

Figure 13B:
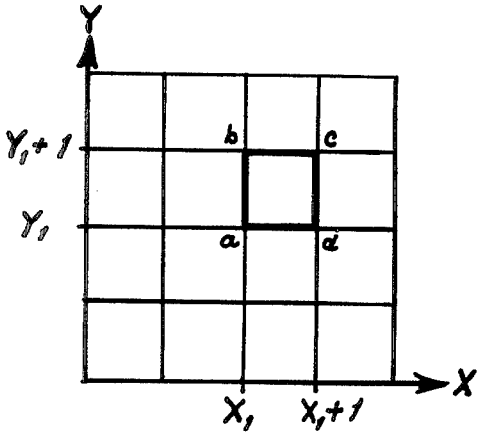
Figure 13C:
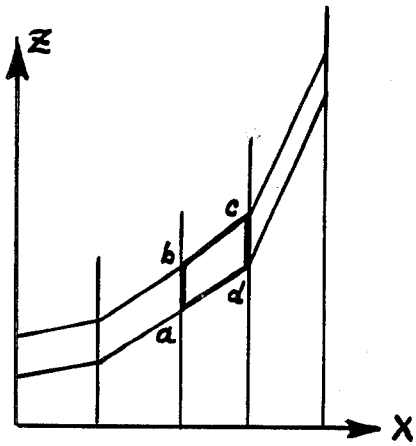

A paraboloid of revolution has the equation (1) $z=k(x^2+y^2)$ where k is the constant which determines the depth of the parabola. Consider a parabolic surface, one quadrant of which is shown in FIG. 13*a*. FIG. 13*b* shows a plan view (viewed from high on the z axis looking down toward the origin) and shows the surface cut by planes $X=0, X=1, X=2, \ldots X=X1, X=X1+1$ and by similarly spaced planes parallel to the Y axis. Four chords of the parabolic surface are shown between the points a, b, c, d. We will determine the shape of the figure abcd in terms of X1, Y1, k.

The required parameters are the angles at abcd, the lengths of the diagonals ac and bd and the lengths of the edges ab bc cd and da.

$$z = k(x^2 + y^2) \quad \text{is the actual equation} \quad (1)$$

$$z_a = k(x_1^2 + y_1^2) \quad \text{of a paraboloid of revolution} \quad (2)$$

-continued $$z_b = k\,(x_1^2 + (y_1 + 1)^2) \tag{3}$$

$$z_c = k[(x_1 + 1)^2 + (y_1 + 1)^2] \tag{4}$$

$$z_d = k[(x_1 + 1)^2 + y_1^2] \tag{5}$$

where the subscripts identify specific points in FIG. 13*a*.

From the above equations, $$ab = [1 + (z_b - z_a)^2]^{\frac{1}{2}} \tag{6}$$

$$bc = [1 + (z_c - z_b)^2]^{\frac{1}{2}} \tag{7}$$

$$cd = [1 + (z_d - z_c)^2]^{\frac{1}{2}} \tag{8}$$

$$da = [1 + (z_d - z_a)^2]^{\frac{1}{2}} \tag{9}$$

The expressions for Z differences are $$z_b - z_a = k(2y_1 + 1) \tag{10}$$

$$z_c - z_d = k(2y_1 + 1) \tag{11}$$

which when substituted in (6) and (9) give:

$$z_b - z_a = z_c - z_d \tag{12}$$

and $$ab = cd \tag{13}$$

by similar reasoning using equations 12, 8, 9

$$bc = ad \tag{14}$$

The opposite sides of the figure abcd are equal. The lengths of the edges are:

$$ab = cd = [1 + k\,(2y_1 + 1)^2]^{\frac{1}{2}} \tag{15}$$

$$bc = ad = [1 + k\,(2x_1 + 1)^2]^{\frac{1}{2}} \tag{16}$$

A plane thru abc is given by equation (17)

$$mx + ny + pz = 1 \tag{17}$$

where m, n, p are found from (18) thru (20) by using coordinates of specific points.

$$mx_1 + ny_1 + p\,z_a = 1 \tag{18}$$

$$mx_1 + n\,(y_1 + 1) + p\,z_b = 1 \tag{19}$$

$$m\,(x_1 + 1) + n(y_1 + 1) + p\,z_c = 1 \tag{20}$$

Therefore $$mx_1 + ny_1 + pk\,(x_1^2 + y_1^2) = 1 \tag{21}$$

$$mx_1 + n\,(y_1 + 1) + pk\,(x_1^2 + (y_1 + 1)^2) = 1 \tag{22}$$

and $$m\,(x_1 + 1) + n\,(y_1 + 1) + pk\,[(x_1 + 1)^2 + (y_1 + 1)^2] = 1 \tag{23}$$

which lead to:

$$n + pk\,(2y_1 + 1) = 0 \tag{24}$$

-continued $$m + pk\,(2x_1 + 1) = 0 \tag{25}$$

$$-pk\,(2x_1 + 1)x_1 - pk\,(2y_1 + 1)y_1 + pk\,(x_1^2 + y_1^2) = 1 \tag{26}$$

$$pk\,(-2x_1^2 - x_1 - 2y_1^2 - y_1 + x_1^2 + y_1^2) = 1 \tag{27}$$

$$pk = 1/(-y_1^2 - y_1 - x_1^2 - x_1) \tag{28}$$

$$n = \frac{2y_1 + 1}{y_1(y_1 + 1) + x_1(x_1 + 1)} \tag{29}$$

$$m = \frac{2x_1 + 1}{y_1(y_1 + 1) + x_1\,(x_1 + 1)} \tag{30}$$

Equations 28, 29 & 30 therefore define m, n, and p for substitution in (17) to define a plane thru a, b, c.

With 17 and 30, then $$\frac{2x + 1}{y_1(y_1 + 1) + x_1(x_1 + 1)}\,x + \frac{2y_1 + 1}{y_1(y_1 + 1) + x_1\,(x_1 + 1)}\,y - \frac{1}{k\,[y_1\,(y_1 + 1) + x_1(x_1 + 1)]}\,z = 1 \tag{31}$$

If the coordinates of d satisfy this equation all 4 points lie in a plane.

$$(2x_1 + 1)x + (2y_1 + 1)y - z/k = y_1(y_1 + 1) + x_1(x_1 + 1) \tag{32}$$

$$(2x_1 + 1)\,(x_1 + 1) + (2y_1 + 1)y_1 - y_1(y_1 + 1) - x_1\,(x_1 + 1) = k\,((x_1 + 1)^2 + y_1^2)\,(1/k) \tag{33}$$

$$(x_1 + 1)^2 + Y_1^2 = (x_1 + 1)^2 + y_1^2 \tag{34}$$

Since (34) is an identity, a, b, c, d lie in a single plane. Since opposite sides are equal, the figure is a parallelogram. To find the diagonals bd and ac $$\begin{aligned} bd^2 &= 1^2 + 1^2 + (z_b - z_d)^2 \\ &= 2 + [k(x_1^2 + (y_1 + 1)^2) - k\,((x_1 + 1)^2 + y_1^2)]^2 \\ &= 2 + k^2\,[2y_1 + 1 - 2x_1 - 1]^2 \\ &= 2 + k^2[2y_1 - 2x_1]^2 \end{aligned} \tag{35}$$

Therefore:

$$(bd)^2 = 2 + 4k^2(y_1 - x_1)^2 \tag{36}$$

Similarly:

$$(ac)^2 = 2 + 4k^2\,(x_1 + y_1 + 1)^2 \tag{37}$$

Equations 36 and 37 give the diagonals of the parallelogram. For a vertical truss depth of h, the diagonals between upper and lower parabolic surfaces are also of interest. Denoting by a′ b′ c′ d′ the points on the lower surface at the bottom of verticals and by abcd the points on the upper parabolic surface at the top of the verticals, we wish to find ad′, a′d, ab′, a′b, bc′, b′c, cd′, and c′d $$1^2 + (h - (z_d - z_a))^2 = (ad')^2 \tag{38}$$

$$1^2 + (h + (z_d - z_a))^2 = (a'd)^2 \tag{39}$$

$$\begin{aligned} z_d - z_a &= k(x_1 + 1)^2 + ky_1^2 - kx_1^2 - ky_1^2 \\ &= k(2x_1 + 1) \end{aligned}$$

-continued $$(ad')^2 = 1 + (h - k(2x_1 + 1))^2 \quad (40)$$

$$(a'd)^2 = 1 + (h + k(2x_1 + 1))^2 \quad (41)$$

Similarly $$(ab')^2 = 1^2 + (h - (z_b - z_a))^2 \quad (42)$$

$$(a'b)^2 = 1^2 + (h + (z_b - z_a))^2 \quad (43)$$

$$z_b - z_a = k(2y_1 + 1) \quad (44)$$

$$(ab')^2 = 1 + (h - k(2y_1 + 1))^2 \quad (45)$$

$$(a'b)^2 = 1 + (h + k(2y_1 + 1))^2 \quad (46)$$

From equations 11, 12 and (43), (42) it may be deduced that $$(ab') = dc' \quad (47)$$

$$a'b = d'c \quad (48)$$

$$ad' = bc' \quad (49)$$

$$a'd = b'c \quad (50)$$

Therefore the 8 diagonals of the 4 parallelograms on the verticals are given by equations 40, 41, 43, 46, 47, 48, 49, 50. The angles at abcd may be found from the cosine law from the lengths of sides found in equations 15, 16 and the diagonals from equations 36 and 37.

Although the invention has been described with reference to a particular embodiment, it will be understood to those skilled in the art that the invention is capable of a variety of alternative embodiments within the spirit and scope of the appended claims.

What is claimed is:

1. A deployable, folded antenna apparatus comprising in combination:

a plurality of box truss elements arranged in rows and columns, each of said box truss elements comprising a cube unit, said cube unit comprising in combination:

a vertical member at each corner of said cube unit, top and bottom surface members which are connected respectively between adjacent vertical members to form a cube, said top and bottom surface members are foldable about their midpoints, and, diagonal tapes connected between diagonally opposite corners of adjacent vertical members, said diagonal tapes being coilable at their midpoints, each cube unit being foldable about the midpoint of each top and bottom surface members to form a stowed truss unit, said stowed truss unit being deployable to form a box truss structure, said box truss structure providing a rigid support base.

2. An antenna apparatus as described in claim 1 further including:

support posts at the junction of each of said top surface members, said support posts are respectively connected to said vertical member, each of said support posts comprising a vertical extension of said vertical member, each of said support posts including a support means, and, a surface element dispersed over and supported by said support means on said support posts.

3. An antenna apparatus as described in claim 2 wherein said surface element is a mesh surface.

4. An antenna apparatus as described in claim 2 wherein said surface element is an antenna array surface.

5. An antenna apparatus as described in claim 2 wherein said surface element is a reflector surface.

6. An antenna apparatus as described in claim 2 wherein said surface element comprises a planar surface.

7. An antenna apparatus as described in claim 2 wherein said surface element comprises a parabolic surface.

8. An antenna apparatus as described in claim 6 wherein all vertical members are of equal length, all surface members, top and bottom, are of equal length and all diagonal tapes are of equal length.

9. An antenna apparatus as described in claim 7 wherein said surface element comprises a parabolic antenna.

10. An antenna apparatus as described in claim 7 wherein said top surface members form a plurality of parallelogram surface units, said top and bottom surface members in any row or column are equal, and said diagonal tapes of corresponding diagonals between upper and lower surfaces in any row or column are equal.

* * * * *

UNITED STATES PATENT AND TRADEMARK OFFICE

CERTIFICATE OF CORRECTION

PATENT NO. : 4,482,900

DATED : 13 November 1984

INVENTOR(S) : Frank V. Bilek et al

It is certified that error appears in the above-identified patent and that said Letters Patent are hereby corrected as shown below:

Column 6, lines 19-23 please correct equation (31) from $$" \frac{2x + 1}{y_1(y_1 + 1) + x_1(x_1 + 1)} x + \frac{2y_1 + 1}{y_1(y_1 + 1) + x_1 (x_1 + 1)} y - \frac{1}{k [y_1 (y_1 + 1) + x_1(x_1 + 1)]} z = 1"$$

to $$-- \frac{2x_1 + 1}{y_1(y_1 + 1) + x_1(x_1 + 1)} x + \frac{2y_1 + 1}{y_1(y_1 + 1) + x_1 (x_1 + 1)} y - \frac{1}{k [y_1 (y_1 + 1) + x_1(x_1 + 1)]} z = 1--.$$

Signed and Sealed this

*Fourteenth* Day of *May 1985*

[SEAL]

*Attest:*

DONALD J. QUIGG

*Attesting Officer* *Acting Commissioner of Patents and Trademarks*